6/7/83 OR 4,387,377

United States Patent [19]

Kandler

[11] 4,387,377

[45] Jun. 7, 1983

[54] APPARATUS FOR CONVERTING THE POLARIZATION OF ELECTROMAGNETIC WAVES

[75] Inventor: Erich Kandler, Munich, Fed. Rep. of Germany

[73] Assignee: Siemens Aktiengesellschaft, Berlin & Munich, Fed. Rep. of Germany

[21] Appl. No.: 269,566

[22] Filed: Jun. 2, 1981

[30] Foreign Application Priority Data

Jun. 24, 1980 [DE] Fed. Rep. of Germany ..... 3023562

[51] Int. Cl.[3] ..... H01Q 19/00

[52] U.S. Cl. ..... 343/756; 343/786; 343/909

[58] Field of Search ..... 343/756, 909–911, 343/872, 786

[56] References Cited

U.S. PATENT DOCUMENTS 3,754,271 8/1973 Epis ..... 343/756
3,762,666 10/1973 Thompson ..... 343/872
3,831,176 8/1974 Epis et al. ..... 343/756
3,854,140 12/1974 Ranghelli et al. ..... 343/756
4,178,574 12/1979 Edens et al. ..... 343/909

*Primary Examiner*—David K. Moore
*Attorney, Agent, or Firm*—Hill, Van Santen, Steadman, Chiara & Simpson

[57] ABSTRACT

Apparatus for converting the polarization of electromagnetic waves from linear polarization to circular polarization wherein a plurality of layers of meandering electrical conductors are formed into a sandwich mounted one above the other wherein at least some of the conductors on different sandwich layers are in phase with each other but in which at least one of the electrical conductors on at least one of the sandwich layers are formed so that adjacent or some of the conductors are not in phase with each other but are phase offset such that the composite structure produces improved circular polarization as compared to polarization converters of the prior art. The sandwich structure according to the invention can be utilized as integrated into a radome of a tracking radar antenna for example.

7 Claims, 6 Drawing Figures

APPARATUS FOR CONVERTING THE POLARIZATION OF ELECTROMAGNETIC WAVES

BACKGROUND OF THE INVENTION

1. Field of the Invention

This invention relates in general to apparatus for converting the polarization of electromagnetic waves from linear to circular polarization and utilizes a plurality of electrical conductors formed in grid structures and arranged in sandwich layers in front of a radiation aperture and with the grid structure comprising electrical conductors designed and formed as periodic meandering lines running essentially parallel with regard to their main longitudinal direction.

2. Description of the Prior Art

Radar antennas and in particular tracking radar antennas are generally designed for linear polarization since under normal conditions the greatest range can be achieved with linear polarization. However, with a linearly polarized antenna, it is not possible to distinguish rain cloud echo signals from real actual moving target echo signals because the rain echo cloud signals have a similar spectral distribution as the actual moving target echo signals. When using circular polarization, the rain cloud echo signals are strongly attenuated. In general, due to the large level range a satisfactory distinction can be made between actual moving targets and rain clouds. Technically, this problem is solved in the prior art in that the linear polarization of the antenna is converted into circular polarization by the use of a polarization grid which is integrated into the radome placed in front of the radiation aperture. A measure of the quality of the circular polarization grid is determined by the ellipticity of the resulting circular polarization and the insertion attenuation wherein the insertion attenuation depends upon the dielectric losses and the reflection of the polarizer.

In the case of known circular polarization grids, all of the layers have the same meander line electrical conductoring structures, but they can as taught in U.S. Pat. No. 3,754,271 be offset or staggered in the plan view from layer to layer relative to their axial position.

SUMMARY OF THE INVENTION

It is an object of the present invention to provide apparatus for converting the polarization of electromagnetic waves from linear to circular polarization such that the ellipticity of the resulting circular polarization over the entire band width is considerably reduced as compared with prior art known circular polarization grids.

According to the invention, this object is achieved by providing that at least one of the grid structures is formed so that its meandering conductor lines relative to its geometric progression are out of phase such that adjacent lines have a mutual phase offset relationship.

When utilizing three layer grid structures formed into sandwiches, the center grid structure layer can be formed such that its adjacent meandering conductor lines always have a phase offset and the two exterior grid structures on the outer layers of the sandwich can be formed such that the conductors meander in lines which run in equiphase relative to each other. Also, in utilizing three grid structure arranged in layers, the center grid structure can be designed as a grid structure which has meandering conductor lines which run in equiphase relative to each other and the two exterior outer grid structures can be designed so that the adjacent meander lines provide phase offset between each other.

The individual grid structures are advantageously arranged with a spatial relationship to each other such that the axes of the meander line of two adjacent grid structures which axes run essentially parallel to one another are offset relative to one another in the plan view. In this manner, the band width of the circular polarization grid particularly at the upper frequency limits is substantially increased.

Advantageously, the meander shaped conductors of a grid structure are formed with etched metal strips mounted on a plastic foil or sheet. So as to maintain the spacing insulating layers are inserted between the foil sheets which insulating layers can be in the form of a honey-combed structure but which could also be for example polymethacrylimide-rigid expanded plastic which forms the actual insulating layers.

In the case of a curved non-planar grid structure, the meandering conductors are applied to a projection in a plane perpendicular to the main axis beam which is parallel to the radiation aperture.

The circular polarization grid according to the invention can be used as an aperture cover of an antenna or it can be integrated into a radome. Particularly, in the case of a tracking radar antenna with a reflector or mirror the integration in the reflector cover can be very desirable.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
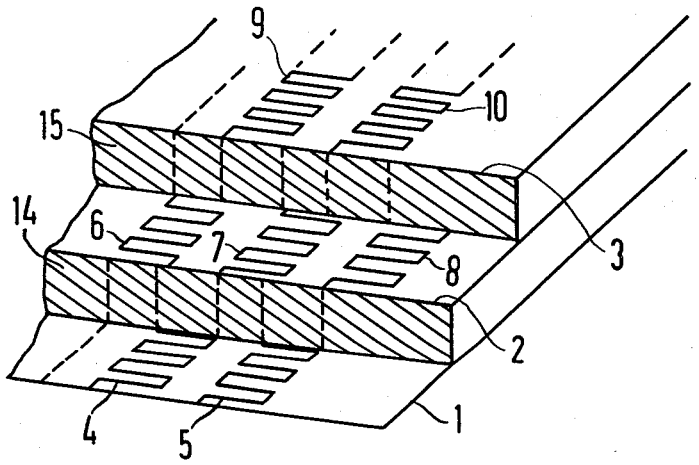
FIG. 1 is a perspective cut-away view of a three layer circular polarization grid according to the invention.

FIG. 1 is a generally cut-away perspective view of a three layer circular polarization grid according to the invention. The polarization grid has three carrier layers 1, 2 and 3 which can be formed of plastic foils or sheets. On the layers 1, 2 and 3, etched meander line metal conductors are formed. For example, the meander lines 4 and 5 are illustrated on sheet 1. Meander lines 6, 7 and 8 are illustrated on sheet 2 and meander lines 9 and 10 are illustrated on sheet 3. It is to be realized, of course, that only a few of the total number of meander lines on each sheet are illustrated but the ones illustrated illustrate the principles of the invention. The longitudinal axes of the meander lines 4 and 5 and 9 and 10 on sheets 1 and 3 are congruent which means that in a plan view the longitudinal axes and the lines 9 and 4 would be coincidence with each other and the lines 10 and 5 would be coincidence with each other. Also, the meander lines 4 and 5 are in phase with each other as are the other conductors formed on sheet 1. Also, the conductors 9 and 10 on sheet 3 as well as the other conductors on sheet 3 are in phase with each other.

The conductors 6, 7 and 8 on the intermediate sheet 2 between the sheets 1 and 3 have their longitudinal axes offset from the longitudinal axes of the conductors 4, 5, 9 and 10 as illustrated in that they generally fall between the conductors 4 and 5 and 9 and 10, respectively. Also, the adjacent conductors 6, 7 and 8 are respectively out of phase with each other.

Between the carrier layers 1 and 2 an insulating spacing layer 14 is provided and between the layers 2 and 3 an insulating spacing layer 15 is provided. The layers 14 and 15 are formed of insulating material and they can be designed in the form of a honey-combed structure.

As stated previously, the meander line-shape metal conductors 4 and 5 of the carrier layer 1 are in coincidence and in equiphase relative to each other with regard to their geometric progression in the axial progression. Likewise, the meandering line-shape metal conductors 9 and 10 on carrier layer 3 are in equiphase relative to each other in their geometric progression.

The conductors 6, 7 and 8 on the center layer 2, however, have a geometric phase offset relative to each other and they are also offset laterally relative to FIG. 1 with the conductors 4, 5, 9 and 10 as shown.

Figure 3:
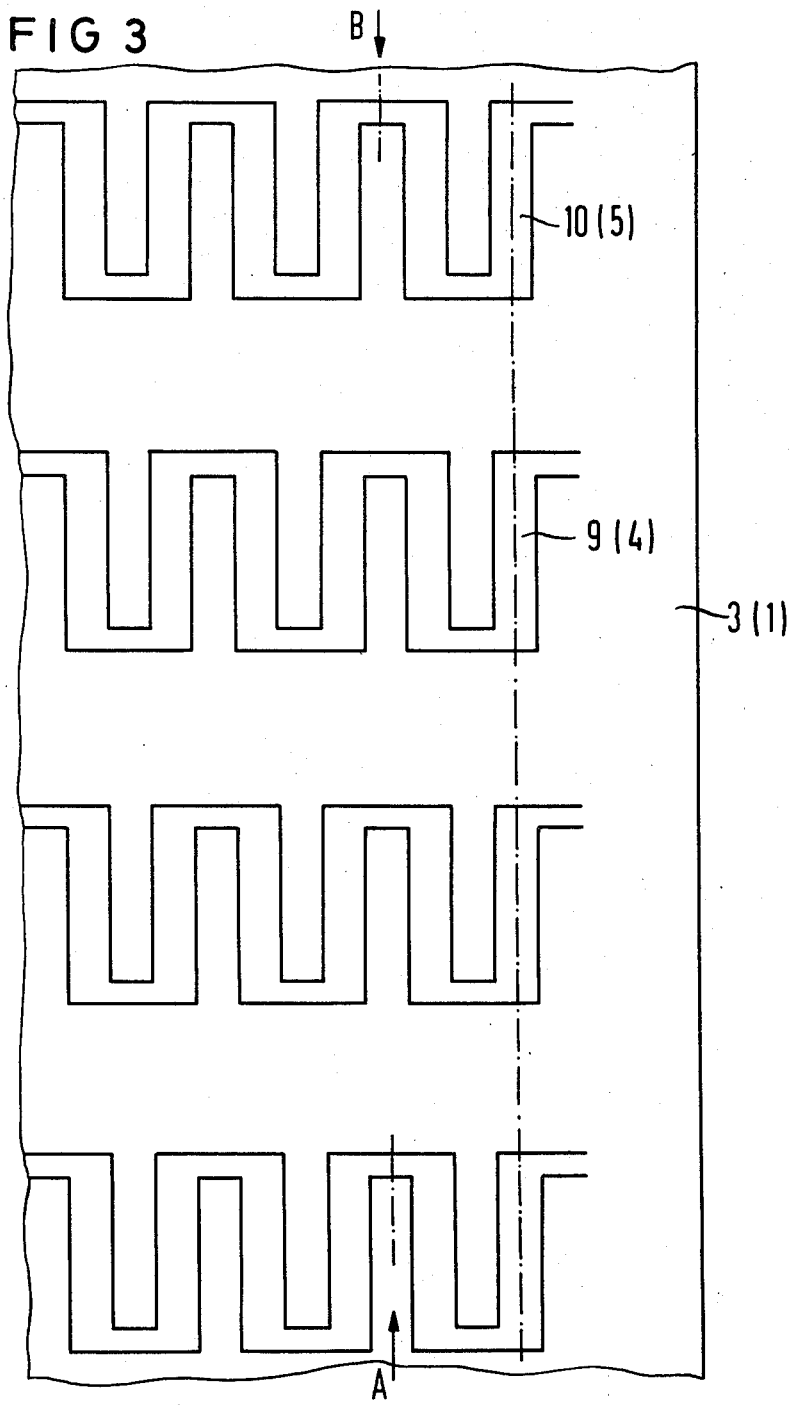
FIG. 3 is a plan view of the grid structure of the two external layers.

FIG. 3 comprises a plan view of the upper carrier layer 3 with the conductors 9 and 10 illustrated as well as two other conductors unnumbered on the lower portion of the sheet 3. Of course, there are many parallel conductors similar to 9 and 10 on the sheet 3 and only relatively few are illustrated for purposes of convenience.

It can be seen as illustrated in FIG. 3 that the conductors 9 and 10 as well as the other two conductors at the lower portion of FIG. 3 are in phase with each other as shown by the dash-dot line to the right of the Figure wherein the portion of conductors 9 and 10 through which the dash-dot line passes is a conductor which is passing upwardly relative to FIG. 3. The same relationship exists relative to the two lower conductors which are unnumbered in FIG. 3 on layer 3. The lower carrier layer 1 and its metal conductors 4 and 5 have the identical shape as in conductors 10 and 9 and also adjacent conductors such as 4 and 5 and the other conductors on sheet 1 do not have any mutual geometric phase offset relative to each other but are aligned as illustrated in FIG. 3.

Figure 4:
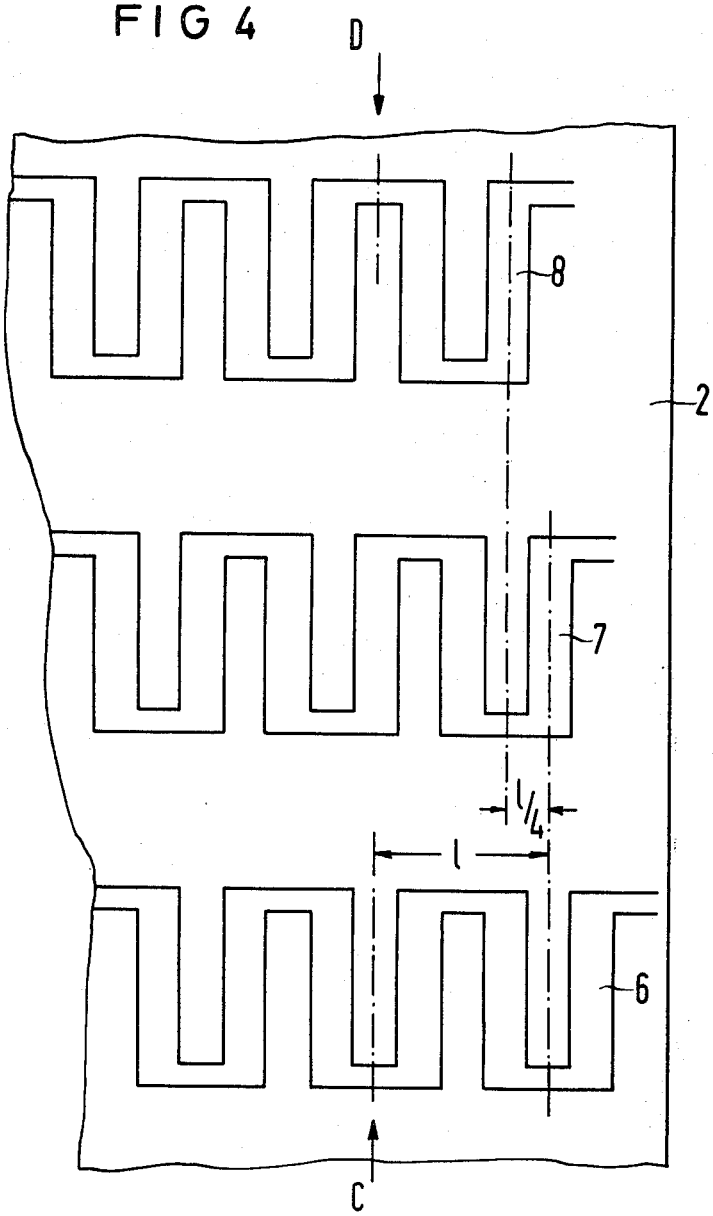
FIG. 4 is a plan view of the grid structure of the center layer.

FIG. 4 illustrates a plan view of the center carrier layer 2 and illustrates the meander lines 6, 7 and 8. The length of one meander period as illustrated on conductor 6 in the lower portion of FIG. 4 is indicated by the reference character l. In a particular example, each of the adjacent conductors 6, 7 and 8 are offset by an amount of l/4. Other offsets other than l/4 can also be utilized so as to improve the measured parameter "ellipticity of the circular polarization". Generally, the offset will be l/n where n can be selected between the values of 0 and 1 (offset=l/n, $0<n<1$).

It is to be noted that the conductor 6 on layer 2 leads the conductor 7 by an amount of l/4 and that the conductor 7 leads the conductor 8 in the axial direction by an amount of l/4 as illustrated.

Figure 2:
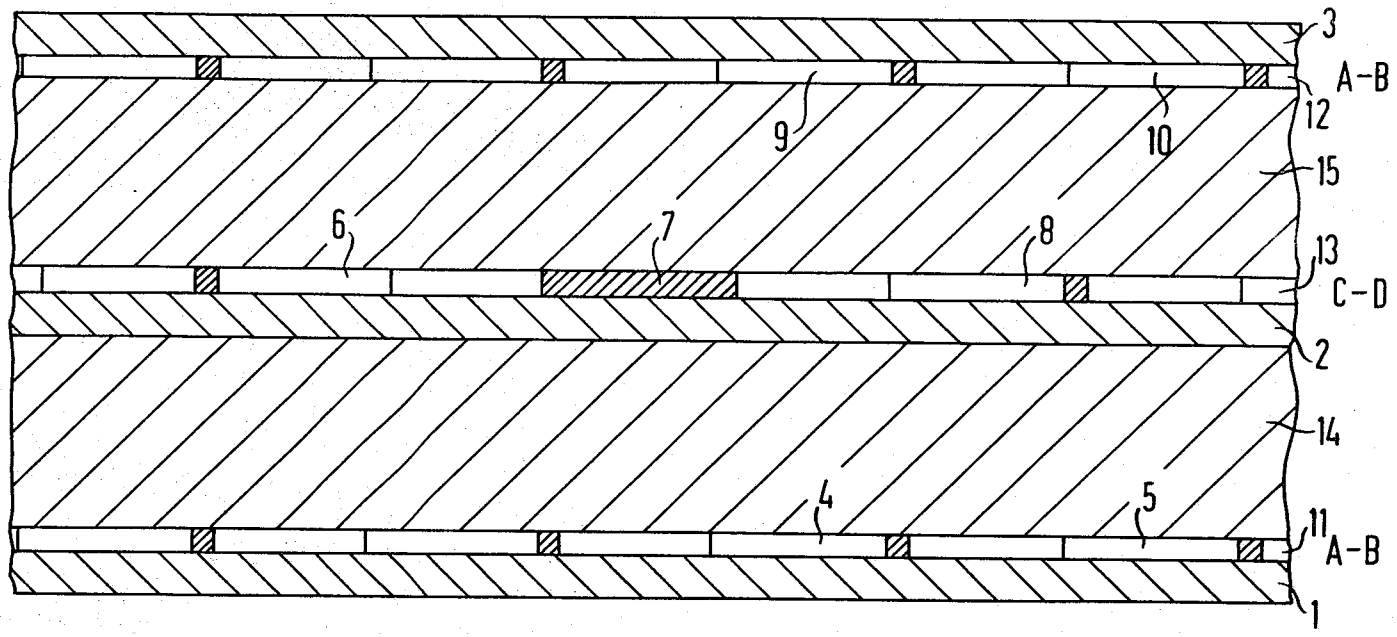
FIG. 2 is a cross-sectional view through the three layer grid of the invention.

FIG. 2 comprises a cross-sectional view through the three layer meander conductor circular polarization grid illustrated in FIG. 1. It is obvious from FIG. 2 that the two external carrier layers 1 and 3 carry metal layers 11 and 12 respectively which have an equiphase geometrical meandering structure as shown by conductors 9 and 10 in FIG. 3. The sectional line is illustrated in FIG. 2 by A-B. The center carrier layer 2 on the other hand, has a metal layer 13 in which the conductors are phase offset as illustrated in FIG. 4. Note, for example, the sectional views of conductors 6, 7 and 8 on line C-D in FIG. 2 and which comports with line C-D in FIG. 4. The conductors 4 and 5 on layer 1 are in phase and aligned in a top plan view with the conductors 9 and 10 and this is illustrated on layer 11 in FIG. 2.

By using a layer variation of the meander conductor structures which are "equal" and "offset" relative to their geometric phase different additional combinations of a three layer meandering grid structure are possible. Thus, the center meandering lines formed on layer 2 could be arranged geometrically in equiphase and the conductors formed on the two outer layers 3 and 1 could be respectively offset relative to each other in the phase relationship. In other words, the center layer 2 could have conductors in the form illustrated in FIG. 3 and the two outer layers 1 and 3 could have conductors of the form illustrated in FIG. 4.

Figure 6:
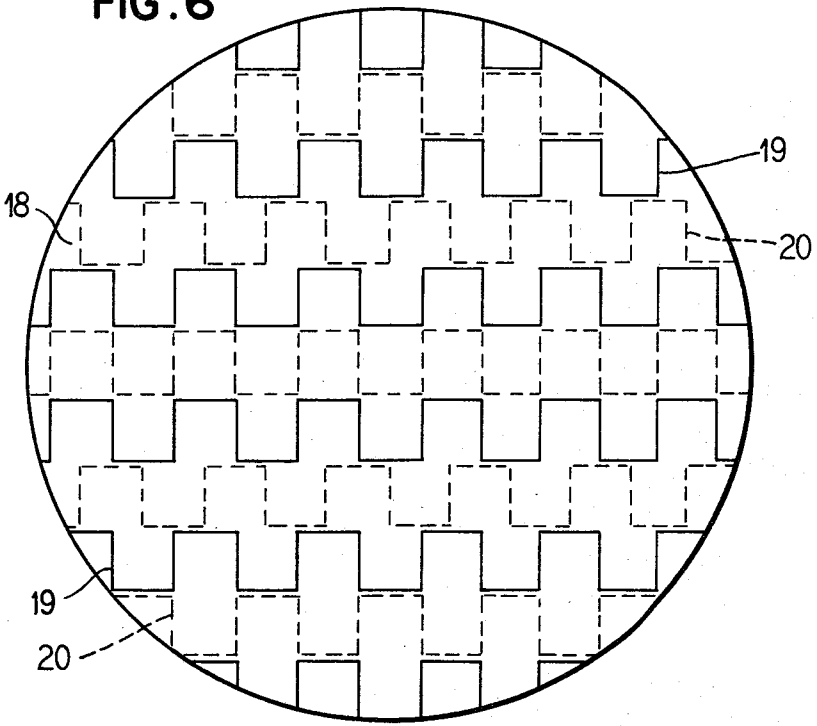
FIG. 6 is a front plan view of the antenna.
Figure 5:
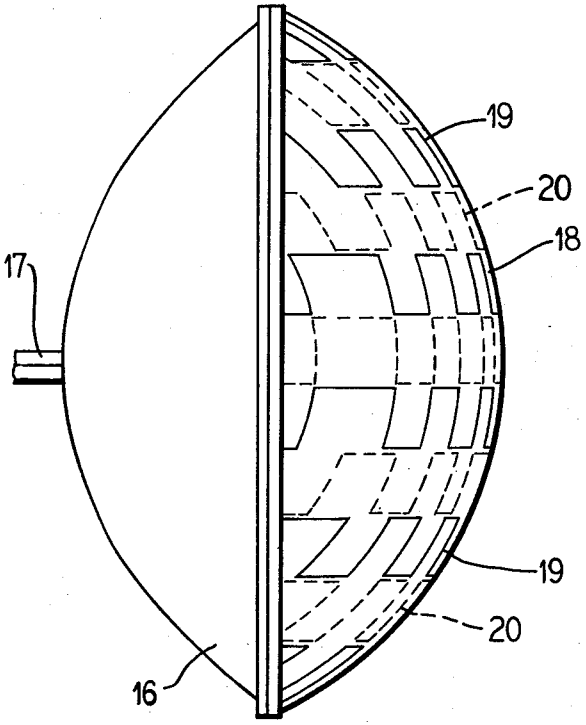
FIG. 5 is a side plan view of a target tracking radar antenna.

FIGS. 5 and 6 illustrate a target tracking radar antenna according to the invention wherein FIG. 5 is a side plan view and FIG. 6 is a front plan view. The target tracking radar antenna has a dynamically balanced reflective mirror 16. The wave guide systems 17 is connected to a suitable primary radiator which supplies energy to the mirror 16 and it is then reflected through the aperture cover radom 18 which fits over the aperture of the antenna including the reflector mirror 16. The radom 16 consists of a radiation permeable material and has the form of a spherical surface segment. Conductive grit structures according to the invention are integrated and formed in the curve reflector cover 18. Two lattice structures which lie one above the other in separate layers are provided and the outer structure 19 is illustrated in solid line and the inner structure 20 is illustrated with broken line. It can be seen in the plan view of FIG. 6, that the meander lines of the two lattice structures 19 and 20 are applied to the curved aperture cover 18 in a manner such that they extend parallel in a plane lying parallel to the plane of the radiation aperture. In other words, in the plane of the drawing of FIG. 16 and are periodic. It also can be seen from FIGS. 5 and 6 that the inner lattice structure illustrated with broken lines consists of meander lines which in sequence from the top toward the bottom are mutually shifted in the longitudinal or axial direction by respective fractions of the period of the meander line to produce a geometrical phase offset.

Although the invention has been described with respect to preferred embodiments, it is not to be so limited as changes and modifications can be made which are within the full intended scope as defined by the appended claims.

I claim as my invention:

1. Apparatus for converting electro-magnetic waves with a given polarization into waves with circular polarization by using a plurality of lattice grid structures comprising, a first layer upon which are formed a first plurality of meandering conductors which have longitudinal axes which are parallel and which are laterally spaced and are mounted so that they are in phase, a second layer upon which are formed a second plurality of meandering conductors which have longitudinal axes which are parallel and which are mounted so that adjacent ones are out of phase and said first and second layers mounted adjacent each other so that their longitudinal axes extend in the same direction and said first and second plurality of meandering conductors offset laterally from each other and said second plurality of meandering conductors out of phase with said first plurality of meandering conductors.

2. Apparatus according to claim 1 including a third layer upon which are a third plurality of meandering conductors which have longitudinal axes which are parallel and are mounted so that they are in phase and said second layer mounted between said first and third layers such that said first and third plurality of meandering conductors are aligned relative to each other and said second plurality of meandering conductors are offset laterally from said first and third plurality of meandering conductors and out of phase with said first and third conductors.

3. Apparatus according to claim 2 wherein said first, second and third plurality of conductors are etched metal strips mounted on said first, second and third layers which are sheets of plastic foil.

4. Apparatus according to claim 3 including insulating sheets mounted between said first and second layers and said second and third layers.

5. Apparatus according to claim 2 wherein for curved non-planar layers said first, second and third plurality of conductors are mounted so that their projection on a perpendicular plane is as defined in claim 2.

6. Apparatus according to claim 2 wherein said first, second and third layers are an aperture cover for an antenna.

7. Apparatus according to claim 6 wherein said antenna is a tracking rod or antenna with a reflector mirror.

* * * * *